US011150569B2

(12) United States Patent
Yamasaki et al.

(10) Patent No.: US 11,150,569 B2
(45) Date of Patent: Oct. 19, 2021

(54) FERRITE CARRIER CORE MATERIAL FOR ELECTROPHOTOGRAPHIC DEVELOPER, CARRIER FOR ELECTROPHOTOGRAPHIC DEVELOPER, AND DEVELOPER

(71) Applicant: POWDERTECH CO., LTD., Kashiwa (JP)

(72) Inventors: Yuzuru Yamasaki, Chiba (JP); Takao Sugiura, Chiba (JP); Takeshi Naito, Chiba (JP); Tetsuya Uemura, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 0 days.

(21) Appl. No.: 16/200,338

(22) Filed: Nov. 26, 2018

(65) Prior Publication Data

US 2019/0163081 A1 May 30, 2019

(30) Foreign Application Priority Data

Nov. 29, 2017 (JP) ..... JP2017-229617

(51) Int. Cl.
*G03G 9/107* (2006.01)
*G03G 9/113* (2006.01)

(52) U.S. Cl.
CPC ..... *G03G 9/1075* (2013.01); *G03G 9/107* (2013.01); *G03G 9/1136* (2013.01); *G03G 9/1139* (2013.01); *G03G 9/1131* (2013.01)

(58) Field of Classification Search
CPC ..... G03G 9/10; G03G 9/107; G03G 9/1075
See application file for complete search history.

(56) References Cited

U.S. PATENT DOCUMENTS 5,976,747 A * 11/1999 Sato ..... G03G 9/107 430/111.31
2011/0212399 A1 9/2011 Suwa et al.
2013/0052580 A1 2/2013 Horie et al.
2014/0017609 A1 1/2014 Kawauchi et al.
(Continued)

FOREIGN PATENT DOCUMENTS

EP 0928998 A1 7/1999
EP 2133750 A1 12/2009
JP 2007-093802 A 4/2007
(Continued)

OTHER PUBLICATIONS

Translation of JP 2011-150253 published Apr. 2011.*
Extended European Search Report for related EP App 18208251.1 dated Mar. 22, 2019, 6 pgs.

*Primary Examiner* — Peter L Vajda
(74) *Attorney, Agent, or Firm* — Procopio, Cory, Hargreaves & Savitch LLP

(57) ABSTRACT

Provided are a ferrite carrier core material for an electrophotographic developer having a full length $L_1$ of grain boundary and a circumference length $L_2$ of the core material in a cross-section of the core material, and satisfying a relationship of $2 \leq L_1/L_2 \leq 9$; a carrier for an electrophotographic developer including the ferrite carrier core material and a coating layer containing a resin provided on a surface of the ferrite carrier core material; and an electrophotographic developer including the carrier and a toner.

9 Claims, 1 Drawing Sheet

(56) References Cited

U.S. PATENT DOCUMENTS

| | | | | | |
|---|---|---|---|---|---|
| 2015/0192874 | A1* | 7/2015 | Kinoshita | ..... | G03G 9/107<br>430/111.35 |

FOREIGN PATENT DOCUMENTS

| | | | | | |
|---|---|---|---|---|---|
| JP | 2008-089869 | A | | 4/2008 | |
| JP | 2008-203623 | A | | 9/2008 | |
| JP | 2011-150253 | | * | 4/2011 | ..... G03G 9/10 |
| JP | 2011-180296 | A | | 9/2011 | |
| JP | 2012-215681 | A | | 11/2012 | |
| JP | 2013-065006 | A | | 4/2013 | |
| JP | 2013-231840 | A | | 11/2013 | |
| JP | 2017-031031 | A | | 2/2017 | |
| JP | 2017146495 | A | | 8/2017 | |
| WO | 2016194272 | A1 | | 12/2016 | |

* cited by examiner

FERRITE CARRIER CORE MATERIAL FOR ELECTROPHOTOGRAPHIC DEVELOPER, CARRIER FOR ELECTROPHOTOGRAPHIC DEVELOPER, AND DEVELOPER

TECHNICAL FIELD

The present invention relates to a ferrite carrier core material for electrophotographic developer, a carrier for electrophotographic developer, and a developer.

BACKGROUND

The electrophotographic development method is a method in which toner particles in a developer are made to adhere to electrostatic latent images formed on a photoreceptor to develop the images. The developer used in this method is classified into a two-component developer composed of a toner particle and a carrier particle, and a one-component developer using only a toner particle.

As a development method using the two-component developer composed of a toner particle and a carrier particle among those developers, a cascade method and the like were formerly employed, but a magnetic brush method using a magnet roll is now in the mainstream. In the two-component developer, a carrier particle is a carrier substance which is agitated with a toner particle in a development box filled with the developer to impart a desired charge to the toner particle, and further transports the charged toner particle to a surface of a photoreceptor to form toner images on the photoreceptor. The carrier particle remaining on a development roll to hold a magnet is again returned from the development roll to the development box, mixed and agitated with a fresh toner particle, and used repeatedly in a certain period.

In the two-component developer, unlike a one-component developer, the carrier particle has functions of being mixed and agitated with a toner particle to charge the toner particle and transporting the toner particle, and it has good controllability on designing a developer. Therefore, the two-component developer is suitable for using in a full-color development apparatus requiring a high image quality, a high-speed printing apparatus requiring reliability for maintaining image and durability, and the like. In the two-component developer thus used, it is needed that image characteristics such as image density, fogging, white spots, gradation, and resolving power exhibit predetermined values from the initial stage, and additionally these characteristics do not vary and are stably maintained during the durable printing period (i.e., a long period of time of use). In order to stably maintain these characteristics, characteristics of a carrier particle contained in the two-component developer need to be stable.

Conventionally, an iron powder carrier such as an iron powder whose surface is covered with an oxide film or an iron powder whose surface is coated with a resin has been used as a carrier particle for forming the two-component developer. However, such an iron powder carrier is heavy with a true specific gravity of about 7.8 and has an excessively high magnetization. Therefore, stirring and mixing the iron powder carrier with toner particles in the developing box easily causes fusion of toner constituent components to the surface of the iron powder carrier, so-called toner spent. Due to such toner spent, an effective earner surface area is decreased, and triboelectric charging capacity with the toner particles tends to be deteriorated. In addition, in the resin-coated iron powder carrier, the resin on the surface is peeled off due to stress during durability, and the core material (iron powder) having a high conductivity and low dielectric breakdown voltage is exposed, so that charge leakage may occur. Due to such charge leakage, an electrostatic latent image formed on a photoreceptor is destroyed, brush line and the like are generated in a solid portion and therefore, it is difficult to obtain a uniform image. For these reasons, the iron powder carriers such as oxide film-coated iron powder and resin-coated iron powder have been no longer used.

In recent years, instead of the iron powder carrier, a ferrite carrier which is light with a true specific gravity of about 5.0 and has a low magnetization, and a resin-coated ferrite carrier which is a ferrite carrier whose surface is coated with a resin, are used more frequently and the life span of the developer has been remarkably increased. As a method for producing such a ferrite carrier, it is general to perform mixing a predetermined amount of ferrite carrier raw materials, calcining, pulverizing, granulating, and then, firing. The calcination may be omitted depending on conditions.

Incidentally, in recent years, networking of offices progresses, and the time changes from a single-function copying machine to a multifunctional machine. In addition, a service system also shifts from a system where a service person who contracts to carry out regular maintenance and to replace a developer or the like to the time of a maintenance-free system. The demand for further extending the life of the developer from the market is increasing more and more.

Under such circumstances, in order to improve the carrier characteristics, it has been proposed to control a surface shape and a pore volume of the carrier core material. For example, Patent Document 1 (JP-A 2017-31031) proposes a ferrite particle represented by Composition formula: $Mn_xFe_{3-x}O_4$ (here, $0<X<1$), further containing Sr element of from 0.4% by mass to 0.5% by mass and Si element of from 0.01% by mass to 0.09% by mass, and having a maximum height Rz of the particle being within a range of from 1.40 μm to 1.90 μm and a standard deviation a of Rz being within a range of from 0.65 μm to 0.80 μm. It is described that the proposed ferrite particle has specific irregularities formed on the surface with predetermined variations and thus, in the case of being used as a carrier core material of an electrophotographic image forming apparatus, carrier scattering or occurrence of a memory image (phenomenon that influence of the previous image appears in a late image) can be remarkably suppressed.

In addition, Patent Document 2 (JP-A 2013-231840) proposes a carrier core material for an electrophotographic developer, containing manganese and iron as a core composition, which is produced in such a manner that a manganese-containing raw material and an iron-containing raw material are mixed with each other and subjected to granulation, the obtained granulated powder is fired in a temperature range of from 1,050° C. to 1,300° C., and among the obtained sintered powders, components present in a grain boundary part of sintered crystal is removed. It is described that this core material can provide an excellent image while achieving a high chargeability and low density even when being used for a long period of time.

Furthermore, Patent Document 3 (JP-A 2012-215681) proposes a carrier core material for an electrophotographic developer, containing iron and strontium as a core composition, satisfying a relationship of $0<y\leq5{,}000$ ppm when y represents the content of strontium contained in the carrier core material for an electrophotographic developer; and having an average particle size value being within a range of from 20 μm to 30 μm, a BET specific surface area value being within a range of from 0.15 $m^2/g$ to 0.25 $m^2/g$ and a pore volume value by a mercury penetration method being within a range of from 0.003 ml/g to 0.023 ml/g. It is described that this core material can realize a small particle size as well as high strength.

Patent Document 1: JP-A 2017-31031

Patent Document 2: JP-A 2013-231840

Patent Document 3: JP-A 2012-215681

SUMMARY

On the one hand, attempts to improve carrier characteristics by controlling a surface shape and a pore volume of a carrier core material; but on the other hand, in response to further demands for high image quality and high speed printing in recent years, there is a problem in that carrier characteristics are not sufficient. Particularly, in the high speed printing, it is necessary to set a bias voltage high in order to increase a toner transfer amount. However, the conventional product has a problem that it easily causes dielectric breakdown to cause image defects such as white spots. It is considered that this is because the conventional carrier prevents the dielectric breakdown by coating, but the coating layer is peeled off and thus the carrier core material is exposed with use. Therefore, in order to improve the carrier characteristics, it is preferable to improve the properties of the carrier core material itself.

In order to prevent dielectric breakdown under a high bias in the ferrite carrier core material for an electrophotographic developer, the present inventors have found that it is important to control a ratio ($L_1/L_2$) of a full length $L_1$ of grain boundary to a circumference length $L_2$ of the core material in a cross-section of the core material. Specifically, the present inventors have found that when the ratio $L_1/L_2$ is appropriately controlled, the dielectric breakdown does not occur in the carrier even under a high bias, image defects such as white spots and carrier adhesion can be suppressed for long period of time.

Accordingly, an object of the present invention is to provide a fertile carrier core material for an electrophotographic developer, which does not cause dielectric breakdown even under a high bias and can suppress image defects such as white spots and carrier adhesion for long period of time. In addition, another object of the present invention is to provide a carrier for electrophotographic developer and a developer, including such a ferrite carrier core material.

According to one aspect of the present invention, provided is a ferrite carrier core material for an electrophotographic developer having a full length $L_1$ of grain boundary and a circumference length $L_2$ of the core material in a cross-section of the core material, and satisfying a relationship of $2 \leq L_1/L_2 \leq 9$.

According to another aspect of the present invention, provided is a carrier for an electrophotographic developer including the ferrite carrier core material and a coating layer containing a resin provided on a surface of the ferrite carrier core material.

According to another aspect of the present invention, provided is an electrophotographic developer including the carrier and a toner.

EMBODIMENTS

Figure 1:
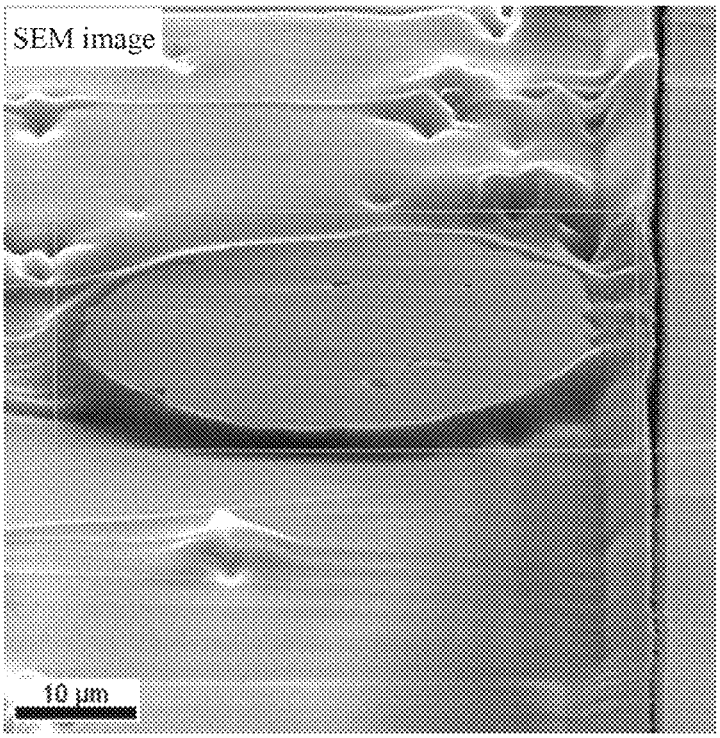
FIG. 1 is a cross-sectional SEM image of the ferrite carrier core material obtained in Example 4.

Ferrite Carrier Core Material for Electrophotographic Developer:

In the ferrite carrier core material for an electrophotographic developer of the present invention, full length $L_1$ of grain boundary and circumference length $L_2$ of the core material in a cross-section of the core material satisfy a relationship of $2 \leq L_1/L_2 \leq 9$. Such a ferrite carrier core material can provide a carrier which does not cause dielectric breakdown even under a high bias and can suppress image defects such as white spots and carrier adhesion for long period of time. In the case where $L_1/L_2$ is less than 2, dielectric breakdown tends to occur easily. This problem is remarkable particularly when a coating layer becomes thin due to a high electric field and durable printing. On the other hand, in the case where $L_1/L_2$ exceeds 9, the carrier resistance is excessively high and it becomes difficult to obtain a sufficient image density. $L_1$ and $L_2$ preferably satisfy a relationship of $3 \leq L_1/L_2 \leq 8$, and more preferably satisfy a relationship of $4 \leq L_3/L_2 \leq 7$.

Here, the full length $L_1$ of grain boundary and the circumference length $L_2$ of the core material can be obtained by scanning electron microscope (SEM) observation and an electron backscatter diffraction (EBSD) analysis of the cross-section of the carrier core material. That is, the circumference length $L_2$ of the core material can be obtained by observing the cross-section of the carrier core material by SEM, and the full length $L_1$ of grain boundary can be obtained by EBSD analysis of the sample subjected to the cross-section observation. EBSD is a technique of projecting a diffraction pattern of a reflected electron emitted from a sample crystal onto a detector surface and analyzing crystal orientation from the projected pattern. Unlike X-ray diffraction which can provide only average information, EBSD provides information for each crystal grain. Therefore, information including crystal grain image and crystal grain boundary structure line can be obtained by performing the crystal orientation analysis. In the present invention, first, in the EBSD data, when the difference in orientation between adjacent measurement points exceeds 15°, a gram boundary is considered to be present between the measurement points, thereby obtaining an EBSD grain map (crystal grain image). Next, this grain map is analyzed, and the full length $L_1$ of grain boundary is calculated based on the following expression.

$$\text{Full length } L_1 \text{ of grain boundary} = [\{\text{total sum of(equivalent circle diameter of crystal grain} \times \pi)\} - \text{circumference length of core material}]/2 \quad \text{[Expression 1]}$$

In the ferrite carrier core material, the content ratio of particles (hereinafter, also referred to as "small irregularity particles") having a shape factor SF-2 of 150 or less is preferably 30% or more on a number basis. Here, the shape factor SF-2 is an index for evaluating the shape of the carrier core material, and as the shape of the carrier core material becomes closer to a sphere, a value of the index becomes closer to 100; and as the surface irregularity of the earner core material becomes larger, the value becomes larger. Here, the shape factor SF-2 can be obtained by observing the ferrite particle with a field emission type scanning electron microscope (FE-SEM) and analyzing the obtained image. In the present invention, a projected area (S) and a projected circumference length ($L_3$) of the ferrite particle are obtained by image analysis, and the shape factor SF-2 is calculated based on the following expression.

$$\text{SF-2} = \{(L_3^2/S)/4\pi\} \times 100 \quad \text{[Expression 2]}$$

The carrier core material containing small irregularity particles within the above-described ratio can suppress the exposure of the core material when used in a carrier, and as a result, the occurrence of problems such as carrier adhesion can be further suppressed. The reason for this is that in the case where the ratio of the small irregularity particles is set to 30% or more, the reduction in resistance of the carrier due to the surface exposure of the core material is suppressed, and as a result, the carrier adhesion is further suppressed. In addition, excessively-dense filling of the powder and an increase in a total current path resulting from the excessively-dense filling are suppressed, and as a result, the occurrence of dielectric breakdown can be more effectively suppressed. The ratio of the small irregularity particles is more preferably from 35% to 90%, and still more preferably from 45% to 85%.

Furthermore, in the ferrite carrier core material, a core resistance $R_{1000}$ (unit: Ω) at the time of applying an electric voltage of 1,000 V and a core resistance $R_{500}$ (unit: Ω) at the time of applying an electric voltage of 500 V at a 6.5 mm gap preferably satisfy a relationship of $5.0 \leq \mathrm{Log}_{10}(|R_{500}-R_{1000}|) \leq 11.0$. In the case where $\mathrm{Log}_{10}(|R_{500}-R_{1000}|)$ is set to be 5.0 or more, the occurrence of dielectric breakdown when the coating layer becomes thin due to a high electric field and durable printing can be further suppressed, and in the case of being set to be 11.0 or less, the occurrence of the problem in that the carrier resistance becomes excessively high and a sufficient image density is difficult to be obtained can be further suppressed. The core resistances $R_{1000}$ and $R_{500}$ more preferably satisfy a relationship of $6.0 \leq \mathrm{Log}_{10}(|R_{500}-R_{1000}|) \leq 10.0$, still more preferably satisfy a relationship of $6.5 \leq \mathrm{Log}_{10}(|R_{500}-R_{1000}|) \leq 9.0$, and particularly preferably satisfy a relationship of $7.0 \leq \mathrm{Log}_{10}(|R_{500}-R_{1000}|) \leq 8.5$. The core resistances can be measured with an insulation resistance meter by filling and holding a sample between parallel plate electrodes and applying a voltage of 500 V or 1,000 V.

The ferrite carrier core material has a volume average particle diameter (D50) of preferably from 20 μm to 80 μm. In the case where the volume average particle size is set to be 20 μm or more, the carrier adhesion can be more effectively suppressed, and in the case of being set to be 80 μm or less, uneven development can be further suppressed. The volume average particle diameter (D50) is more preferably from 25 μm to 70 μm, and still more preferably from 30 μm to 65 μm. The volume average particle diameter can be measured by using a microtrac particle size distribution meter.

Furthermore, the ferrite carrier core material shows a magnetization at 1 kOe (80 kA/m) being preferably from 40 emu/g to 75 emu/g. In the case where the magnetization is set to be 40 emu/g or more, the occurrence of carrier adhesion can be further suppressed, and in the case of being set to be 75 emg/g or less, the occurrence of uneven development due to overly strong bristles of a magnetic brush can be more effectively suppressed. The magnetization is more preferably from 45 emg/g to 70 emu/g, and still more preferably from 50 emg/g to 70 emu/g. The magnetization of the ferrite carrier core material can be measured by using a vibrating sample type magnetometer.

The ferrite carrier core material has an apparent density of preferably from 1.6 g/cm$^3$ to 2.6 g/cm$^3$. In the case where the apparent density is set to be 1.6 g/cm$^3$ or more, the occurrence of carrier adhesion due to the reduction in magnetization of one particle can be further suppressed, and in the case of being set to be 2.6 g/cm$^3$ or less, the peeling of the coating layer due to stirring stress with toner can be further suppressed. The apparent density is more preferably from 1.7 g/cm$^3$ to 2.5 g/cm$^3$, and still more preferably from 1.8 g/cm$^3$ to 2.4 g/cm$^3$. The apparent density can be measured based on JIS Z 2504: 1979.

In the ferrite carrier core material, the proportion of particles having a particle size of less than 24 μm (hereinafter, referred to as "fine powder amount") is preferably 4.5% by volume or less. In the case where the fine powder amount is set to be 4.5% by volume or less, the problem of the carrier adhesion can be further suppressed. The fine powder amount is more preferably 3.5% by volume or less, and still more preferably 2.5% by volume or less. A lower limit of the fine powder amount is not particularly limited, and is typically 0.1% by volume or more. The fine powder amount can be measured by using a microtrac particle size distribution meter.

Although not particularly limited, the ferrite carrier core material preferably has a composition of $(MnO)_x(MgO)_y(Fe_2O_3)_z$ in which x+y+z=100% by mol is satisfied, x is from 15% to 60% by mol, y is from 0.1% to 35% by mol, and a part of MnO, MgO and $Fe_2O_3$ is replaced with an oxide of an element capable of being divalent. The ferrite carrier core material more preferably has a composition of $(MnO)_x(MgO)_y(Fe_2O_3)_z$ in which x+y+z=100% by mol is satisfied, x is from 15% to 60% by mol, y is from 0.1% to 35% by mol, and a part of MnO, MgO and $Fe_2O_3$ is replaced with SrO in an amount of from 0.35% to 5.0% by mol. Still more preferably, the ferrite carrier core material has a composition of $(MnO)_x(MgO)_y(Fe_2O_3)_z$ in which the respective oxides are blended so as to satisfy x+y+z=100% by mol, x being from 35% to 45% by mol and y being from 5% to 15% by mol, and a predetermined amount of SrO or $SrCO_3$ or the like which finally provides SrO is blended in the oxides so as to have a composition in which a part of MnO, MgO and $Fe_2O_3$ is replaced with SrO in an amount of from 0.4% to 2.0% by mol. Such a composition can reduce variations in magnetization among the carrier core materials and therefore, a carrier which is excellent in image quality and durability, is environmentally friendly and has a long life span and excellent environmental stability can be obtained.

Carrier for Electrophotographic Developer:

The carrier for an electrophotographic developer, according to the present invention, includes the above-described ferrite carrier core material and a coating layer made of a resin provided on a surface of the ferrite carrier core material. The carrier characteristics may be affected by the material present on the carrier surface and its properties. Therefore, by coating the surface of the ferrite carrier core material with an appropriate resin, desired carrier characteristics can be adjusted with high accuracy.

The coating resin is not particularly limited. Examples thereof include a fluororesin, an acrylic resin, an epoxy resin, a polyamide resin, a polyamide imide resin, a polyester resin, an unsaturated polyester resin, a urea resin, a melamine resin, an alkyd resin, a phenol resin, a fluorine acrylic resin, an acrylic-styrene resin, a silicone resin, or a silicone resin modified with any resin of an acrylic resin, polyester resin, epoxy resin, polyamide resin, polyamide imide resin, alkyd resin, urethane resin, and fluororesin. In consideration of desorption of the resin due to mechanical stress during use, a thermosetting resin is preferably used. Specific examples of the thermosetting resin include an epoxy resin, a phenol resin, a silicone resin, an unsaturated polyester resin, a urea resin, a melamine resin, an alkyd resin, and a resin containing them. The coverage with resin is preferably from 0.1 to 5.0 parts by weight with respect to 100 parts by weight of the ferrite carrier core material (before resin coating).

In addition, for the purpose of controlling the carrier characteristics, a conductive agent and a charge control agent can be contained in the coating resin. Examples of the conductive agent include conductive carbon, oxides such as titanium oxide and tin oxide, and various organic conductive agents. The additive amount of the conductive agent is preferably from 0.25% to 200.0% by weight, more preferably from 0.5% to 150.0% by weight, and still more preferably from 1.0% to 130.0% by weight, based on the solid content of the coating resin. Examples of the charge control agent include various charge control agents commonly used for toners, and various silane coupling agents. The kinds of the charge control agents and coupling agents capable of being used are not particularly limited, and preferred are the charge control agents such as nigrosine dyes, quaternary ammonium salts, organometallic complexes, and metal-containing monoazo dyes, aminosilane coupling agents, and fluorine-containing silane coupling agents. The additive amount of the charge control agent is preferably from 1.0% to 50.0% by weight, more preferably from 2.0% to 40.0% by weight, and still more preferably from 3.0% to 30.0% by weight, based on the solid content of the coating resin.

Method for Preparing Ferrite Carrier Core Material for Electrophotographic Developer and Carrier:

In preparing the carrier for electrophotographic developer, according to the present invention, first, the ferrite carrier core material is prepared. In preparing the carrier core material, raw materials are weighed and then, pulverized and mixed for 0.5 hour or more, preferably from 1 to 24 hours, with a ball mill, vibration mill or the like. Although the raw materials are not particularly limited, the raw materials are preferably blended so as to have a composition of $(MnO)_x(MgO)_y(Fe_2O_3)_z$ in which x+y+z=100% by mol is satisfied, x is from 15% to 60% by mol, y is from 0.1% to 35% by mol, and a part of MnO, MgO and $Fe_2O_3$ is replaced with an oxide of an element capable of being divalent. The raw materials are more preferably blended so as to have a composition of $(MnO)_x(MgO)_y(Fe_2O_3)_z$ in which x+y+z=100% by mol is satisfied, x is from 15% to 60% by mol, y is from 0.1% to 35% by mol, and a part of MnO, MgO and $Fe_2O_3$ is replaced with SrO in an amount of from 0.35% to 5.0% by mol. Still more preferably, the respective oxides are blended so as to have a composition of $(MnO)_x(MgO)_y(Fe_2O_3)_z$ in which x+y+z=100% by mol is satisfied, x is from 35% to 45% by mol and y is from 5% to 15% by mol, and a predetermined amount of SrO or $SrCO_3$ or the like which finally provides SrO is blended in the oxides so as to have a composition in which a part of MnO, MgO and $Fe_2O_3$ is replaced with SrO in an amount of from 0.4% to 2.0% by mol. The pulverized material obtained in this way is palletized by using a pressure molding machine or the like and then, calcination is performed at a temperature of from 700° C. to 1,200° C.

Next, the calcined product is pulverized with a ball mill, vibration mill or the like. At that time, wet pulverization may be carried out by adding water to the calcined product so as to form a slurry, and if necessary, a dispersant, binder or the like may be added to adjust the viscosity of the slurry. Furthermore, the degree of pulverization can be controlled by adjusting a diameter of the medium used at the time of pulverization, the composition, pulverization time, or the like. Thereafter, the pulverized calcined product is granulated by using a spray dryer so as to perform granulation. The particle size of the recovered granulated material may be adjusted if necessary.

Furthermore, the obtained granulated material is heated at a temperature of from 400° C. to 1,200° C. to remove the organic components such as the added dispersant and binder, and then sintering is performed at a temperature of from 800° C. to 1,500° C. under an atmosphere with a controlled oxygen concentration for 1 to 24 hours. At that time, a rotary electric furnace, a batch electric furnace, a continuous electric furnace, or the like can be used. In addition, the oxygen concentration may be controlled by introducing an inert gas such as nitrogen or a reducing gas such as hydrogen or carbon monoxide into the atmosphere during firing. Alternatively, a gas previously prepared by adjusting nitrogen and oxygen may be introduced. Next, the fired material thus obtained is disintegrated and classified. The disintegration may be performed by adopting any one of a hammer mill, jet mill and the like or in combination thereof. The particle size may be adjusted to a desired particle size by adopting any one of a conventional wind classification method, mesh filtration method, sedimentation method, and the like or in combination thereof.

Thereafter, if necessary, the recovered particles may be subjected to an oxide film-coating treatment by heating the surface at a low temperature to adjust the electric resistance. The oxide film-coating treatment can be carried out by using a general rotary electric furnace, batch electric furnace or the like, and the heat treatment can be performed at from 300° C. to 700° C., for example. The thickness of the oxide film formed by this treatment is preferably from 0.1 nm to 5 μm. In the case where the thickness is set to be 0.1 nm or more, the effect of the oxide film layer becomes sufficient; whereas in the case of 5 μm or less, decrease in magnetization mid becoming excessive high resistance can be more effectively suppressed. If necessary, a reduction treatment may be performed before the oxide film-coating treatment. In this way, the carrier core material can be produced.

There are various methods as means for adjusting the foil length $L_1$ of grain boundary and the circumference length $L_2$ of the core material in the cross-section of the carrier core material. One example thereof is to adjust the pulverized particle size of the calcined product. The pulverized particle size is preferably from 1.1 μm to 3.5 μm, and more preferably from 2.0 μm to 2.5 μm. It is also effective to adjust the temperature and atmosphere at the time of sintering. The temperature at the time of sintering is preferably from 1,200° C. to 1,270° C. and more preferably from 1,220° C. to 1,260° C., and the oxygen concentration is preferably from 2.5% to 5.0% by volume and more preferably from 3.0% to 4.5% by volume. Furthermore, another applicable method is adding a compound that suppresses the crystal growth of ferrite, to the raw material. Examples of the compound that suppresses the crystal growth of ferrite includes potassium iodide. Potassium iodide is preferable because it sublimes in the sintering temperature range so as not to remain in the final product and does not cause deterioration of the carrier core material. The additive amount of potassium iodide is preferably from 0.05% to 0.5% by weight, and more preferably from 0.1% to 0.4% by weight.

As described above, it is desirable to prepare a carrier by coating the surface with a resin after preparing the carrier core material. As a method of coating, known methods such as a brush coating method, a dry method, a spray drying method using a fluidized bed, a rotary dry method, a liquid immersion drying method using a universal stirrer, and the like can be employed. In order to improve the coverage rate, the method using a fluidized bed is preferable. In the case of performing baking after the resin coating, any one of an external heating method or an internal heating method may be used. For example, the baking may be performed by using a fixed or flow electric furnace, a rotary electric furnace, a burner furnace, or microwave. In the case of using a UV curable resin, a UV heater is used. Although the temperature for baking varies depending on the resin to be used, it is preferable to set it at a temperature or higher than a melting point or a glass transition point of the resin. As for a thermosetting resin, a condensation-crosslinked resin or the like, it is preferable to raise the temperature to a temperature at which curing sufficiently proceeds.

Developer:

The developer of the present invention contains the above-described carrier for an electrophotographic developer and a toner. The toner particles constituting the developer include pulverized toner particles produced by a pulverization method and polymerized toner particles produced by a polymerization method. In the present invention, the toner particles obtained by any method can be used. The developer of the present invention thus prepared can be used for digital copying machines, printers, facsimiles, printing machines, and the like using a developing system in which an electrostatic latent image formed on a latent image holding member having an organic photoconductor layer is reversely developed by using a magnetic brash of a two-component developer having toner and carrier while applying a bias electric field to the electrostatic latent image. Furthermore, the developer of the present invention is also applicable to a full color machine using an alternating electric field which is a method of superimposing an AC bias on a DC bias when a developing bias is applied from the magnetic brush to the electrostatic latent image side.

EXAMPLES

The present invention will be described more specifically with reference to the following Examples.

Example 1

(1) Preparation of Ferrite Carrier Core Material:

Raw materials were weighed so as to have MnO: 38% by mol, MgO: 11% by mol, $Fe_2O_3$: 50.3% by mol, and SrO: 0.7% by mol. The raw materials were pulverized with a dry media mill (vibration mill, stainless steel beads of ⅛ inch diameter) for 4.5 hours, and the pulverized materials obtained were made into pellets of about 1 mm square by using a roller compactor. Manganese tetraoxide was used as a MnO raw material, magnesium hydroxide was used as a MgO raw material, and strontium carbonate was used as a SrO raw material. A coarse powder was removed by using a vibration sieve with an opening of 3 mm, then a fine powder was removed by using a vibration sieve with an opening of 0.5 mm. The obtained pellet was heated at 1,050° C. for three hours in a rotary electric furnace so as to perform calcining.

Next, the calcined product was pulverized by using a dry media mill (vibration mill, stainless steel beads of ⅛ inch diameter) to have an average particle diameter of 2.4 μm, then water and potassium iodide was added in an amount of 0.34% by weight with respect to the solid content, and the mixture was further pulverized for ten hours by using a wet media mill (vertical bead mill, stainless steel beads of 1/16 inch diameter). A suitable amount of a dispersant was added to the obtained slurry, polyvinyl alcohol (PVA, 20% aqueous solution) as a binder was further added thereto in an amount of 0.2% by weight with respect to the solid content, and the mixture was granulated and dried with a spray dryer. The particle size of the obtained particles (granulated materials) was adjusted, and the particles were heated at 700° C. for two hours in a rotary electric furnace so as to remove organic components such as a dispersant and a binder.

Subsequently, the granulated material from which the organic component was removed was held in a tunnel electric furnace for five hours under an atmosphere of a firing temperature of 1,250° C. and an oxygen concentration of 4.0% by volume so as to perform sintering. At this time, a heating rate was set to 150° C./hour and a cooling rate was set to 110° C./hour. Thereafter, the obtained fired material was disintegrated and further classified to adjust the particle size, and a low magnetic force product was separated by magnetic separation so as to obtain a ferrite carrier core material. The preparation conditions for the ferrite carrier core material is shown in Table 1.

(2) Evaluation:

For the obtained ferrite carrier core material, evaluations of various properties were carried out as follows.

Measurements of Full Length $L_1$ of Grain Boundary and Circumference Length $L_2$ of Core Material:

The full length $L_1$ of a grain boundary and the circumference length $L_2$ of the ferrite carrier core material were obtained as follows. First, a sample was embedded with a resin and polished by using a cross-section polisher apparatus (CP apparatus, Model 693 ilion, manufactured by Gatan), to thereby prepare a sample for observation in which the polished cross-section was exposed. Next, this sample was subjected to a SEM observation and EBSD analysis by using a scanning electron microscope (SEM, SUPRA 55VP, manufactured by Carl Zeiss AG) equipped with an electron backscatter diffraction (EBSD) device (Pegasus system, manufactured by EDAX Corporation/TSL Solutions Co., Ltd). At that time, observation and analysis were carried out under conditions of an accelerating voltage of 20 kV, an aperture diameter of 60 mm, a high current mode, a sample inclination angle of 70 degrees, a step size of from 0.2 μm to 0.05 μm, and a phase base of $Fe_3O_4$. In addition, OIM Data Collection/OIM Analysis, manufactured by TSL Solutions Co., Ltd. was used as software for measurement and analysis.

Thereafter, the full length $L_1$ of the grain boundary and the circumference length $L_2$ of the core material were calculated from the obtained SEM image and EBSD data. At that time, 10 particles in the vicinity of the average particle size were arbitrarily selected as core material particles to be measured, the full length of the grain boundary and the circumference length were measured for these 10 particles, and the average values thereof were calculated and taken as $L_1$ and $L_2$, respectively. Here, the circumference length of the core material was obtained by image analysis of SEM image. Also, in the EBSD data, an EBSD grain map was created by determining that when the difference in orientation between adjacent measurement points exceeds 15°, a grain boundary is present between the measurement points. From this gram map, the foil length $L_1$ of the grain boundary of the cross-section of the core material particle was calculated based on the following expression.

$$\text{Full length } L_1 \text{ of grain boundary} = [\{\text{total sum of(equivalent circle diameter of crystal grain} \times \pi)\} - \text{circumference length of core material}]/2 \quad \text{[Expression 1]}$$

Shape Factor SF-2:

For the ferrite carrier core material, the measurement of the shape factor SF-2 was carried out as follows. That is, the ferrite particle was photographed with a field of view at 450-fold magnification by using FE-SEM (SU-8020, manufactured by Hitachi High-Technologies Corporation), and the obtained image information was introduced into image analysis software (Image-Pro PLUS, manufactured by Media Cybernetics) through an interface and analyzed, to thereby obtain a projected area (S) and a projected circumference length ($L_3$). SF-2 for each particle was calculated from the following expression. The same operation was carried out for 100 particles, and the proportion (number %) of particles (small irregularity particles) having the shape factor SF-2 of 150 or less was calculated.

$$SF\text{-}2=\{(L_3^2/S)/4\pi\}\times 100 \quad \text{[Expression 2]}$$

Volume Average Particle Diameter and Fine Powder Amount:

The volume average particle diameter of the ferrite carrier core material was measured by using a microtrac particle size distribution meter (Model 9320-X100, manufactured by Nikkiso Co., Ltd). Water was used as a dispersion medium. First, 10 g of the sample and 80 ml of water were put into a 100 ml beaker and 2 to 3 drops of a dispersant (sodium hexametaphosphate) were added thereto. Next, by using an ultrasonic homogenizer (UH-150 model, manufactured by SMT Co. Ltd.) and setting an output level was set to 4 and dispersion was performed for 20 seconds. Thereafter, foam formed on a beaker surface was removed, and the sample was introduced into the apparatus. A proportion (fine powder amount, % by volume) of the particles having a particle size of less than 24 μm was also measured and calculated.

Magnetic Properties:

The magnetic properties of the ferrite carrier core material were measured by using a vibrating sample type magnetic measurement device (VSM-C7-10A, manufactured by Toei industry Co., Ltd). The measurement sample was packed in a cell having an inner diameter of 5 mm and a height of 2 mm and set in this device, and then an applied magnetic field was applied and swept up to 1 kOe (80 kA). Thereafter, the applied magnetic field was decreased so as to create a hysteresis curve on a recording paper. From the data of this curve, magnetization at an applied magnetic field of 1 kOe was obtained.

Apparent Density:

The apparent density of the ferrite carrier core material was measured based on JIS Z 2504: 1979. Specifically, the measurement was carried out as follows. First, as a powder apparent density meter, a device including a funnel, a cup, a funnel support, a support rod, and a support base was used. A balance having a weighing capacity of 200 g and sensitivity of 50 mg was used. At the time of the measurement, at least 150 g of sample was subjected to the measurement. This sample was poured into the funnel having an orifice with a pore size of 2.5+0.2/−0 mm, and the flowing sample was poured into the cup until the sample was overflowing. As soon as it began to overflow, the sample was stopped flowing, and the sample raised on the cup was scraped flat with a spatula along the top of the cup without giving vibration. Thereafter, the side of the cup was tapped lightly to sink the sample, the sample attached to the outside of the cup was removed, and the weight of the sample in the cup was weighed with an accuracy of 0.05 g. The numerical value obtained by multiplying the obtained weighed value by 0.04 was rounded to second decimal place in accordance with JIS-Z 8401: 1961 (way of rounding the numerical value), to thereby obtain an apparent density in [g/cm$^3$] unit.

Electric Resistance:

The electric resistance of the ferrite carrier core material was measured as follows. That is, nonmagnetic parallel plate electrodes (10 mm×40 mm) were placed so as to face to each other with an interval of 6.5 mm between electrodes, and 200 mg of the sample was weighed and filled therebetween. The sample was held between the electrodes by attaching a magnet (surface magnetic flux density: 1,500 Gauss, the area of the magnet in contact with the electrode: 10 mm×30 mm) to the parallel plate electrode. A voltage of 500 V and 1,000 V were applied to the sample and the electric resistance was measured by using an insulation resistance meter (SM-8210, manufactured by DKK-TOA Corporation). The measurement was carried out after exposing the sample to a constant temperature and constant humidity condition at a temperature of from 20° C. to 25° C. and a humidity of from 50% to 60% for at least 12 hours.

Carrier Adhesion:

In evaluating carrier adhesion, first, a developer for evaluation was prepared according to the following method. That is, a silicone resin (trade name: SR-2440, solid content of 20% by weight, manufactured by Dow Corning Toray Co., Ltd) and an aminosilane coupling agent (KBM-603, manufactured by Shin-Etsu Silicone Co., Ltd.) were dissolved in a toluene solvent. The resultant was put into a uniaxial indirect heating dryer to coat the carrier core material, and baking was further performed at 250° C. for three hours, thereby obtaining a carrier coated with the resin. At this time, the resin solution used was prepared by weighing the resin so that the solid content of the resin with respect to the carrier core material was 1% by weight, and adding an aluminum-containing catalyst (CAT-AC) so as to be 3% by weight, the aminosilane coupling agent (KBM-603) so as to be 1% by weight and toluene as a solvent so as to be 10% by weight, with respect to the solid content of the resin, respectively. Then, the obtained carrier was used as a developer for evaluation. Since this developer was for evaluating the carrier adhesion, toner was not added.

Next, the carrier adhesion was evaluated by using the following method. That is, used was an apparatus provided with a cylindrical aluminum pipe (hereinafter, referred to as a "sleeve") having a diameter of 40 mm and a length of 110 mm, a magnet roller in which a total of eight magnets (magnetic flux density of 0.1 T) were arranged inside the sleeve so that a N pole and a S pole were alternate, and a cylindrical electrode disposed on the outer periphery of the sleeve so as to have a gap of 5.0 mm. Onto the sleeve was evenly adhered 1 g of the developer for evaluation, then, with the outer aluminum pipe kept fixed, while rotating the inner magnet roller at 100 rpm, a DC voltage of 600 V was applied between the outer electrode and the sleeve for 60 seconds. After the lapse of 60 seconds, the applied voltage was turned off, the rotation of the magnet roller was stopped, then, the outer electrode was removed, and the number of carrier particles transferred to the electrode was counted.

In accordance with the number of adhered carrier particles, the samples were evaluated based on the following criteria so as to rate as A to C.

A: Less than 20 adhesion carriers

B: 20 or more and less than 40 adhesion carriers

C: 40 or more adhesion carriers

Example 2

A ferrite carrier core material was prepared and evaluated in the same manner as in Example 1 except that the amount of potassium iodide added was changed to 0.1% by weight at the time of pulverization of the calcined product.

Example 3

A ferrite carrier core material was prepared and evaluated in the same manner as in Example 1 except that potassium iodide was not added and the average particle size was adjusted to 1.5 μm at the time of pulverization of the calcined product, and the sintering conditions were changed to an atmosphere with the firing temperature of 1,200° C. and the oxygen concentration of 5.0% by volume.

Example 4

Figure 2:
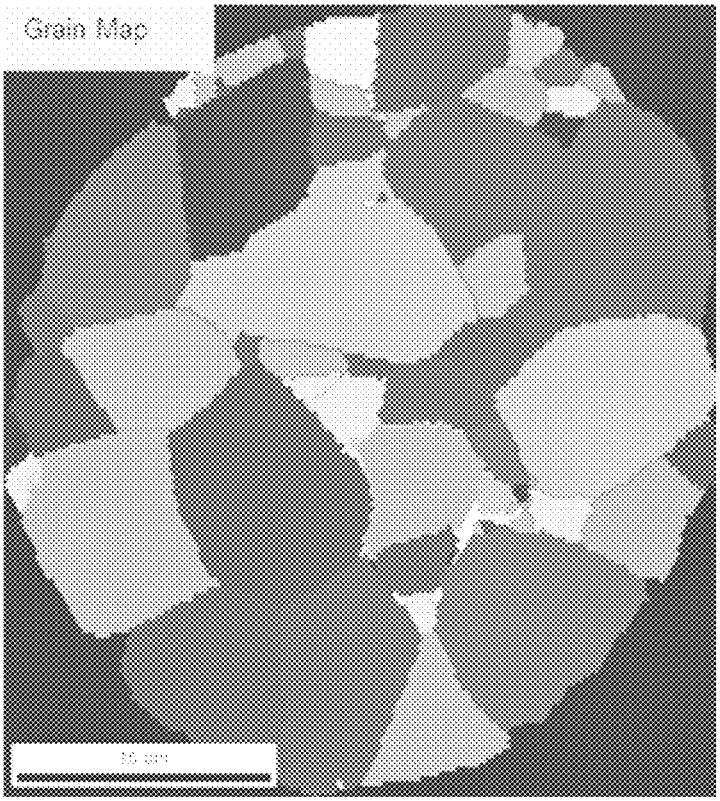
FIG. 2 is an EBSD grain map of the ferrite carrier core material obtained in Example 4.

A ferrite carrier core material was prepared and evaluated in the same manner as in Example 1 except that potassium iodide was not added and the average particle size was adjusted to 3.5 μm at the time of pulverization of the calcined product, and the sintering conditions were changed to an atmosphere with the firing temperature of 1,200° C. and an oxygen concentration of 5.0% by volume. The ferrite carrier core material obtained in Example 4 was subjected to a SEM observation and an EBSD analysis. The results are shown in FIG. 1 and FIG. 2, respectively.

Example 5

A ferrite carrier core material was prepared and evaluated in the same manner as in Example 1 except that potassium iodide was not added and the average particle size was adjusted to 3.5 μm at the time of pulverization of the calcined product, and the sintering conditions were changed to an atmosphere with the firing temperature of 1,270° C. and an oxygen concentration of 2.5% by volume.

Example 6

A ferrite carrier core material was prepared and evaluated in the same manner as in Example 1 except that potassium iodide was not added and the average particle size was adjusted to 1.2 μm at the time of pulverization of the calcined product, and the sintering conditions were changed to an atmosphere with the firing temperature of 1,210° C. and an oxygen concentration of 2.5% by volume.

Example 7

Comparative Example

A ferrite carrier core material was prepared and evaluated in the same manner as in Example 1 except that potassium iodide was not added and the average particle size was adjusted to 1.0 μm at the time of pulverization of the calcined product, and the sintering conditions were changed to an atmosphere with the firing temperature of 1,140° C. and an oxygen concentration of 7.0% by volume.

Example 8

Comparative Example

Raw materials were weighed so as to have MnO: 38% by mol, MgO: 11% by mol, $Fe_2O_3$: 50.3% by mol, and SrO: 0.7% by mol. The raw materials were pulverized with a dry media mill (vibration mill, stainless steel beads of ⅛ inch diameter) for 4.5 hours, and the pulverized materials obtained were made into pellets of about 1 mm square by using a roller compactor. Manganese tetraoxide was used as a MnO raw material, magnesium hydroxide was used as a MgO raw material, and strontium carbonate was used as a SrO raw material. A coarse powder was removed from the pellet by using a vibration sieve with an opening of 3 mm, then a fine powder was removed by using a vibration sieve with an opening of 0.5 mm. The obtained pellet was heated at 1,050° C. for three hours in a rotary electric furnace so as to perform calcining. Next, the calcined product was pulverized by using a dry media mill (vibration mill, stainless steel beads of ⅛ inch diameter) to have an average particle diameter of 3.8 μm, then water was added, and the mixture was further pulverized for ten hours by using a wet media mill (vertical bead mill, stainless steel beads of 1/16 inch diameter). A suitable amount of a dispersant was added to the obtained slurry, PVA (20% aqueous solution) as a binder was further added thereto in an amount of 0.2% by weight with respect to the solid content, the mixture was granulated and dried with a spray dryer, and the particle size of the obtained particles (granulated materials) was adjusted. The obtained granulated material was fed at a feeding rate of 40 kg/hr to pass through flame to which 5 $Nm^3$/hr of propane and 25 $Nm^3$/hr of oxygen were fed, to thereby obtain a sintered material. Thereafter, the obtained sintered material was disintegrated, further classified to adjust the particle size, and a low magnetic force product was separated by magnetic separation, to thereby obtain a ferrite carrier core material.

Results:

In Examples 1 to 8, the obtained evaluation results are as shown in Table 2. In Examples 1 to 6 which are Inventive Examples, the obtained ferrite carrier core materials were excellent in insulating property when a high bias was applied and the number of scattered carriers was small. Particularly, in Examples 1 and 2 in which the ferrite carrier core materials were prepared by using potassium iodide as a crystal growth inhibitor, the number of scattered carriers was small and the effect of suppressing carrier adhesion was excellent. On the other hand, in Examples 7 and 8 which are Comparative Examples, the insulating property was somewhat deteriorated, the number of scattered carriers was large, and the effect of suppressing carrier adhesion was poor. From these results, it can be understood that according to the present invention, a ferrite carrier core material for an electrophotographic developer, carrier for an electrophotographic developer and developer, which do not cause dielectric breakdown even under a high bias and can suppress image defects such as white spots and carrier adhesion for long period of time, can be provided.

TABLE 1

| | Sintering conditions | | Additive amount of | Pulverized particle size of |
|---|---|---|---|---|
| | Firing temperature (° C.) | Oxygen concentration (% by volume) | potassium iodide (% by weight) | calcined product (μm) |
| Example 1 | 1,250 | 4.0 | 0.34 | 2.4 |
| Example 2 | 1,250 | 4.0 | 0.10 | 2.4 |
| Example 3 | 1,200 | 5.0 | None | 1.5 |
| Example 4 | 1,200 | 5.0 | None | 3.5 |
| Example 5 | 1,270 | 2.5 | None | 3.5 |
| Example 6 | 1,210 | 2.5 | None | 1.2 |

TABLE 1-continued

| | Sintering conditions | | Additive amount of | Pulverized particle size of |
|---|---|---|---|---|
| | Firing temperature (° C.) | Oxygen concentration (% by volume) | potassium iodide (% by weight) | calcined product (μm) |
| Example 7* | 1,140 | 7.0 | None | 1.0 |
| Example 8* | — | — | None | 3.8 |

*indicates Comparative Example.

TABLE 2

| | $L_1/L_2$ | Ratio of small irregularity particles (% by number) | Volume average particle diameter (μm) | Magnetization (emu/g) | Apparent density (g/cm$^3$) | Fine powder amount (% by volume) | $Log_{10}$ ($\lvert R_{1000} - R_{500}\rvert$) | Carrier adhesion: Number of scattered carriers | Carrier adhesion: Evaluation |
|---|---|---|---|---|---|---|---|---|---|
| Ex. 1 | 5.2 | 60 | 30 | 58 | 2.30 | 2.1 | 8.4 | 7 | A |
| Ex. 2 | 6.5 | 75 | 32 | 59 | 2.25 | 2.3 | 7.3 | 9 | A |
| Ex. 3 | 8.8 | 78 | 35 | 60 | 2.31 | 3.3 | 8.9 | 21 | B |
| Ex. 4 | 2.3 | 48 | 46 | 48 | 2.28 | 3.1 | 8.6 | 36 | B |
| Ex. 5 | 3.3 | 32 | 52 | 48 | 2.42 | 1.8 | 8.7 | 25 | B |
| Ex. 6 | 7.2 | 88 | 60 | 55 | 2.20 | 1.4 | 8.8 | 29 | B |
| Ex. 7* | 9.5 | 25 | 30 | 35 | 1.93 | 4.6 | 9.3 | 59 | C |
| Ex. 8* | 0.2 | 98 | 35 | 60 | 2.61 | 3.6 | — | 62 | C |

*indicates Comparative Example.

While the present invention has been described in detail with reference to specific embodiments, it will be apparent to those skilled in the art that various changes and modifications can be made without departing from the spirit and scope of the invention.

This application is based on Japanese Patent Application (No. 2017-229617) filed on Nov. 29, 2017, the contents of which are incorporated herein by reference.

What is claimed is:

1. A ferrite carrier core material for an electrophotographic developer, having a full length $L_1$ of grain boundary and a circumference length $L_2$ of the core material in a cross-section of the core material, and satisfying a relationship of $2 \leq L_1/L_2 \leq 7$, wherein:

the full length $L_1$ of grain boundary is based on a length of all grain boundaries in the cross-section of the carrier core materials;

the ferrite carrier core material has a magnetization at 1 kOe (80 kA/m) being from 45 emu/g to 75 emu/g; and the ferrite carrier core material has a composition of $(MnO)_x(MgO)_y(Fe_2O_3)_z$, wherein:

x+y+z=100% by mol is satisfied, x is from 15% to 60% by mol, y is from 0.1% to 35% by mol, and a part of MnO, MgO and $Fe_2O_3$ is replaced with SrO in an amount of from 0.35% to 5.0% by mol.

2. The ferrite carrier core material according to claim 1, comprising particles having a shape factor SF-2 of 150 or less in an amount of 30% or more on a number basis.

3. The ferrite carrier core material according to claim 1, satisfying a relationship of $5.0 \leq Log_{10}(\lvert R_{500}-R_{1000}\rvert) \leq 11.0$, wherein $R_{500}$ represents a core resistance with unit Ω at the time of applying an electric voltage of 500 V at a gap of 6.5 mm and $R_{1000}$ represents a core resistance with unit Ω at the time of applying an electric voltage of 1,000 V at a gap of 6.5 mm.

4. The ferrite carrier core material according to claim 1, having a volume average particle diameter of from 20 μm to 80 μm.

5. The ferrite carrier core material according to claim 1, having an apparent density of from 1.6 g/cm$^3$ to 2.6 g/cm$^3$.

6. The ferrite carrier core material according to claim 1, having a proportion of particles having a particle size of less than 24 μm being 4.5% by volume or less.

7. A carrier for an electrophotographic developer, comprising the ferrite carrier core material of claim 1 and a coating layer containing a resin provided on a surface of the ferrite carrier core material.

8. An electrophotographic developer, comprising the carrier of claim 7 and a toner.

9. The ferrite carrier core material of claim 1, wherein the ferrite carrier core material has a composition of $$(MnO)_x(MgO)_y(Fe_2O_3)_z,$$

wherein:

x+y+z=100% by mol is satisfied, x is from 35% to 45% by mol, y is from 5% to 15% by mol, and a part of MnO, MgO and $Fe_2O_3$ is replaced with SrO in an amount of from 0.4% to 2.0% by mol.

* * * * *